US011111908B2

(12) United States Patent
Rommel et al.

(10) Patent No.: US 11,111,908 B2
(45) Date of Patent: Sep. 7, 2021

(54) HYDROSTATIC SYSTEM AND PUMPING STATION FOR AN OIL OR GAS PIPELINE

(71) Applicant: VOITH PATENT GMBH, Heidenheim (DE)

(72) Inventors: Matthias Rommel, Schwaebisch Gmuend (DE); Bert Brahmer, Bruchsal (DE)

(73) Assignee: Voith Patent GmbH, Heidenheim (DE)

( * ) Notice: Subject to any disclaimer, the term of this patent is extended or adjusted under 35 U.S.C. 154(b) by 232 days.

(21) Appl. No.: 16/327,456

(22) PCT Filed: Jul. 24, 2017

(86) PCT No.: PCT/EP2017/068616

§ 371 (c)(1),
(2) Date: Feb. 22, 2019

(87) PCT Pub. No.: WO2018/036731

PCT Pub. Date: Mar. 1, 2018

(65) Prior Publication Data

US 2019/0195210 A1 Jun. 27, 2019

(30) Foreign Application Priority Data

Aug. 23, 2016 (DE) ..... 10 2016 215 758.2
Sep. 8, 2016 (DE) ..... 10 2016 217 061.9
Sep. 20, 2016 (DE) ..... 10 2016 217 959.4

(51) Int. Cl.
*F02N 7/06* (2006.01)
*F04B 17/05* (2006.01)
*F04B 23/00* (2006.01)
*F02N 15/02* (2006.01)
*F15B 1/02* (2006.01)

(52) U.S. Cl.
CPC ..... *F04B 17/05* (2013.01); *F02N 7/06* (2013.01); *F02N 15/022* (2013.01); *F04B 23/00* (2013.01); *F15B 1/02* (2013.01)

(58) Field of Classification Search
CPC ..... F15B 1/02; F02N 7/06; F02N 7/08; F02N 7/10
See application file for complete search history.

(56) References Cited

U.S. PATENT DOCUMENTS 6,736,099 B2 * 5/2004 Mori ..... F02N 7/08 123/179.31
9,303,612 B2 4/2016 Krittian et al.
9,447,874 B2 9/2016 Meier et al.
10,059,184 B2 8/2018 Roehr et al.
2005/0196298 A1 * 9/2005 Manning ..... F04B 35/04 417/364

(Continued)

FOREIGN PATENT DOCUMENTS

DE 202008008045 U1 11/2009
DE 102011105006 A1 10/2012

(Continued)

*Primary Examiner* — Thomas E Lazo
(74) *Attorney, Agent, or Firm* — Laurence A. Greenberg; Werner H. Stemer; Ralph E. Locher

(57) ABSTRACT

A hydrostatic system has a pressure source and a hydraulic motor or a consumer. An additional hydraulic motor/pump unit is furnished for controlling the volumetric flow for the consumer or the power output of the hydraulic motor.

34 Claims, 2 Drawing Sheets

(56) References Cited

U.S. PATENT DOCUMENTS

| | | | | |
|---|---|---|---|---|
| 2015/0052889 | A1* | 2/2015 | Krittian ..... | F02N 9/04<br>60/596 |
| 2017/0234338 | A1 | 8/2017 | Spielvogel et al. | |

FOREIGN PATENT DOCUMENTS

| | | | |
|---|---|---|---|
| DE | 102012021327 | A1 | 1/2014 |
| DE | 102012108857 | A1 | 3/2014 |
| DE | 102014215567 | A1 | 2/2016 |
| EP | 2891791 | A1 | 7/2015 |
| ES | 1072269 | U | 6/2010 |
| RU | 2035614 | C1 | 5/1995 |

* cited by examiner

HYDROSTATIC SYSTEM AND PUMPING STATION FOR AN OIL OR GAS PIPELINE

BACKGROUND OF THE INVENTION

Field of the Invention

The invention relates generally to a hydrostatic system, and more particularly to a pumping station for an oil or gas pipeline having such a hydrostatic system wherein the hydrostatic system is used to start up an internal combustion engine of the pumping station. The hydrostatic system has a hydraulic pressure source, a first hydraulic motor having an output shaft that forms a mechanical power output of the hydrostatic system, and/or at least one consumer that is provided with pressurized hydraulic medium from the pressure source. The first hydraulic motor for its own propulsion, and/or the at least one consumer for pressurization, is connected to the pressure source by way of a pressure line.

In pumping stations for oil or gas pipelines, also called compressor stations, internal combustion engines such as large gas engines are used, which propel one or more feed pumps for feeding the medium—oil or gas—through the pipeline. Such gas engines have, for example, a power of 1800 to 11000 HP and a starting torque of, for example, 32000 Nm at 4000 NP. In that case, the starting rotational speed may for example be 65 rpm, to be reached within 30 seconds.

Conventionally, the medium supplied via the pipeline, in particular gas, is used to start the internal combustion engine. For environmental reasons, this is no longer desired.

Alternative starting devices for internal combustion engines are disclosed in RU 2 035 614 C1 and ES 1 072 269 U.

The use of a hydrostatic system in particular for starting a corresponding internal combustion engine, but also generally independently of this application, for example generally for propelling a hydraulic motor or for supplying a consumer with a pressurized hydraulic medium, has the drawback that, conventionally, the power consumption of the hydraulic motor or the pressure provided to the consumer is controlled by variably adjustable orifice plates; this is associated with dissipation and reduced efficiency. It is also known to provide a hydraulic motor instead of such an orifice plate; this likewise causes the desired pressure reduction, and also converts the pressure into mechanical propulsive power, which in turn may be converted into electrical energy in a connected electrical generator. By this arrangement, the power absorbed by the hydraulic motor, and thus the pressure drop across the hydraulic motor, may easily be controlled. Drawbacks of this solution, however, include that the hydraulic energy is converted into electrical energy and thus is no longer directly available in the hydraulic system, and also that an electrical control must be furnished, which entails additional expense.

The first drawback, that hydraulic energy is converted into electrical energy and thus is no longer available in the hydrostatic system without reconversion, is particularly serious if a hydraulic accumulator is provided as a pressure source for the hydrostatic system, because more energy is withdrawn from it than is necessary for propelling the hydraulic motor or providing pressure to the consumer. This is an especially serious drawback when using the hydrostatic system for starting the comparatively large internal combustion engine in the pumping station of an oil or gas pipeline, because startup is associated with a particularly high energy consumption based on the aforementioned performance data.

SUMMARY OF THE INVENTION

The present invention has the objective of providing a hydrostatic system that avoids the drawbacks mentioned above and allows efficient control of the hydraulic pressure provided to a consumer and/or the propulsive power of a hydraulic motor, for example, an internal combustion engine, in particular in a pumping station or compressor station of an oil or gas pipeline.

The invention achieves this objective by means of a hydrostatic system having the features of the independent claims. Advantageous and particularly expedient configurations of the invention, as well as a pumping station for an oil or gas pipeline, are provided in the dependent claims.

According to the solution of the invention, it is possible to achieve a pressure reduction in the hydrostatic system by using an additional hydraulic motor that propels a hydraulic pump, which in turn supplies hydraulic medium to the pressure side of the consumer and/or the first hydraulic motor, so that the volumetric flow of the hydraulic medium through the first hydraulic motor and/or the load is increased and the energy contained in the hydraulic medium stream supplied via the hydraulic pump remains in the hydrostatic system as hydraulic energy. By means of the solution according to the invention, a higher efficiency may be achieved than with a variably adjustable orifice plate; and thanks to the capacity for precise control, undesired forces and/or torques are avoided that may lead to rapid acceleration and create hazardous conditions.

According to an alternative configuration, the hydraulic pump is used to supply the first hydraulic motor and/or the consumer with a pressurized hydraulic medium.

In detail, according to one embodiment, a hydrostatic system according to the invention comprises a hydraulic pressure source; and a first hydraulic motor having an output shaft forming a mechanical power output of the hydrostatic system, and/or at least one consumer that is provided with pressurized hydraulic medium from the pressure source.

The first hydraulic motor for its own propulsion, and/or the at least one consumer for pressurization, is/are connected to the pressure source by means of a pressure line.

According to the invention, a hydraulic motor/pump unit is furnished, comprising an additional hydraulic motor (in addition to the first hydraulic motor and/or in addition to the at least one consumer) and a hydraulic pump, which are propulsively connected with each other, such that the hydraulic pump may be propelled by the additional hydraulic motor.

The additional hydraulic motor is connected to the pressure source by means of a pressure line, either for its own propulsion in sequence with the first hydraulic motor, and/or in sequence with the at least one consumer; and the hydraulic pump has a pressure side via which it is connected to the pressure line. Thus, the hydraulic pump supplies pressurized hydraulic medium, in particular from a hydraulic pressure source such as a tank, in the pressure line, which is why this hydraulic medium is, in turn, available for the first hydraulic motor and/or the at least one consumer.

According to an alternative configuration of the invention, it is not necessary to furnish the first hydraulic motor and/or the consumer with pressurized hydraulic medium directly from the pressure source; rather, the hydraulic motor of the hydraulic motor/pump unit that propels the hydraulic pump is connected to the pressure source by means of a pressure line for its own propulsion, and either the first hydraulic motor is connected to a pressure side of the hydraulic pump for its own propulsion, and/or the consumer is connected to a pressure side of the hydraulic pump in order to be supplied with pressurized hydraulic medium.

Preferably, a hydraulic reservoir is provided, in particular in the form of a hydraulic tank or hydraulic sump, from which the hydraulic pressure source is supplied by means of at least one charge pump. The charge pump may then be operated so as to work directly as a hydraulic pressure source, which provides the pressurized hydraulic medium without intermediate storage. Particularly preferably, the hydraulic pressure source has at least one pressure accumulator, to which the charge pump is connected via a charge pump pressure side, for supplying hydraulic medium into the pressure accumulator.

There are various possible ways to propel the charge pump. Preferably, however, an electric motor is furnished for propelling the charge pump.

Preferably, the hydraulic pump has a suction side that is connected to the hydraulic reservoir by means of a suction line. Thus, in one embodiment with a pressure accumulator, the pressure accumulator and the motor/pump unit may be supplied from the same hydraulic reservoir.

According to one embodiment of the invention, the hydraulic pressure source has a plurality of pressure accumulators. Such pressure accumulators may be filled either simultaneously or successively, by means of the at least one charge pump. Such pressure accumulators likewise may be discharged either simultaneously or sequentially, in order to supply the first hydraulic motor and/or the at least one consumer with pressurized hydraulic medium.

According to one embodiment of the invention, in the pressure line, a variably adjustable throttle valve for controlling the pressure is furnished on the input side or output side of the first hydraulic motor and/or the input side or output side of the at least one consumer. In the alternative configuration of the invention, a variably adjustable throttle valve for controlling the pressure is correspondingly furnished in the pressure line on the input side or output side of the additional hydraulic motor. In particular, in this case, the additional hydraulic motor and the hydraulic pump may be rigidly coupled to each other in order to propel the hydraulic pump. Due to the motor/pump unit, the adjustable throttle valve may be smaller than conventionally designed, and thus may produce less dissipation energy.

Preferably, the propulsive connection between the additional hydraulic motor and the hydraulic pump is designed to be exclusively mechanical, in particular by means of said rigid coupling, which may be made for example by a shaft that carries the impellers of the additional hydraulic motor and the hydraulic pump or is connected to the hydraulic pump in a torsionally rigid manner.

In order to make the adjustable throttle valve even smaller in the pressure line or to be able to dispense with it completely, at least one of the two units—the additional hydraulic motor and/or the hydraulic pump—may be designed as an adjustable unit, i.e. as a variable displacement motor and/or variable displacement pump, having a variable adjustable delivery volume per revolution, and in particular having a variably adjustable displacement volume; in particular in the embodiment as a reciprocating piston engine, a variably adjustable displacement volume of the corresponding unit.

According to one embodiment of the invention, a transmission gearing with a variably adjustable speed ratio is furnished in the propulsive connection between the additional hydraulic motor and the hydraulic clutch. In this way, the speed of the hydraulic pump is decoupled from the speed of the additional hydraulic motor, so that the power consumption of the motor/pump unit may be controlled by regulating the rotational speed. Again, the throttle valve furnished in the pressure line may be made smaller and used only for controlling outside the control range of the rotational speed control, or may even be wholly dispensed with.

If both the additional hydraulic motor and the hydraulic pump are designed to be adjustable, the throttle valve may in principle be completely eliminated, and the entire control range may be covered solely by variably adjusting the delivery volume per revolution of both of these units.

In addition to the first hydraulic motor and the additional hydraulic motor, at least one further hydraulic motor and/or at least one consumer is preferably furnished, in which the hydraulic medium is expanded or consumed, and these units also are or may be connected to the pressure line.

According to one configuration of the invention, an electric generator or an electric motor-generator is connected to the hydraulic motor/pump unit, for energy storage or reversible energy storage. The generator or electric motor-generator correspondingly converts propulsive power into electrical energy, so that this energy may be either stored in an electrical energy storage or used for another electrical unit. Correspondingly, when a motor-generator is provided, electric power from the energy storage may be converted into propulsive power to propel the hydraulic motor/pump unit, that is, the additional hydraulic motor and/or the hydraulic pump.

According to an exemplary embodiment of the invention, the additional hydraulic motor may be operated as a hydraulic pump with or without reversing the flow direction of the hydraulic medium flowing through it. The propulsion may be provided for example by the said electric motor-generator or by the hydraulic pump being switchable so that it may be operated by a motor.

If the hydraulic pump may be operated by a motor, it may likewise be used to discharge pressure energy from the hydrostatic system.

If the additional hydraulic motor may be operated as a hydraulic pump, then as a result, the differential pressure at the first hydraulic motor and/or at the at least one consumer may be increased. However, by means of a suitable switching device, the additional hydraulic motor may also be used in a pumping operation to reduce the differential pressure. In general, the additional hydraulic motor may also be used in pumping operation to supply a subsystem of the hydrostatic system with a higher pressure of the hydraulic medium, so that a corresponding high-pressure pump may be omitted.

A pumping station for an oil or gas pipeline according to the invention has at least one feed pump to feed the oil or gas through the pipeline. Furthermore, at least one internal combustion engine is provided for propelling the at least one feed pump.

The internal combustion engine is connected to a hydrostatic system according to the invention, which is then designed as a propulsion system with a first hydraulic motor, and the internal combustion engine is propulsively connected to the first hydraulic motor or may be switched into such a connection. Accordingly, the internal combustion engine is or may be switched into a propulsive connection with the output shaft of the first hydraulic motor. Alternatively, the internal combustion engine, as a consumer, may also be supplied with pressurized hydraulic medium from the hydraulic pump.

In the following, the invention will be described by way of example, with reference to exemplary embodiments and the drawings.

DESCRIPTION OF THE INVENTION

Figure 1:
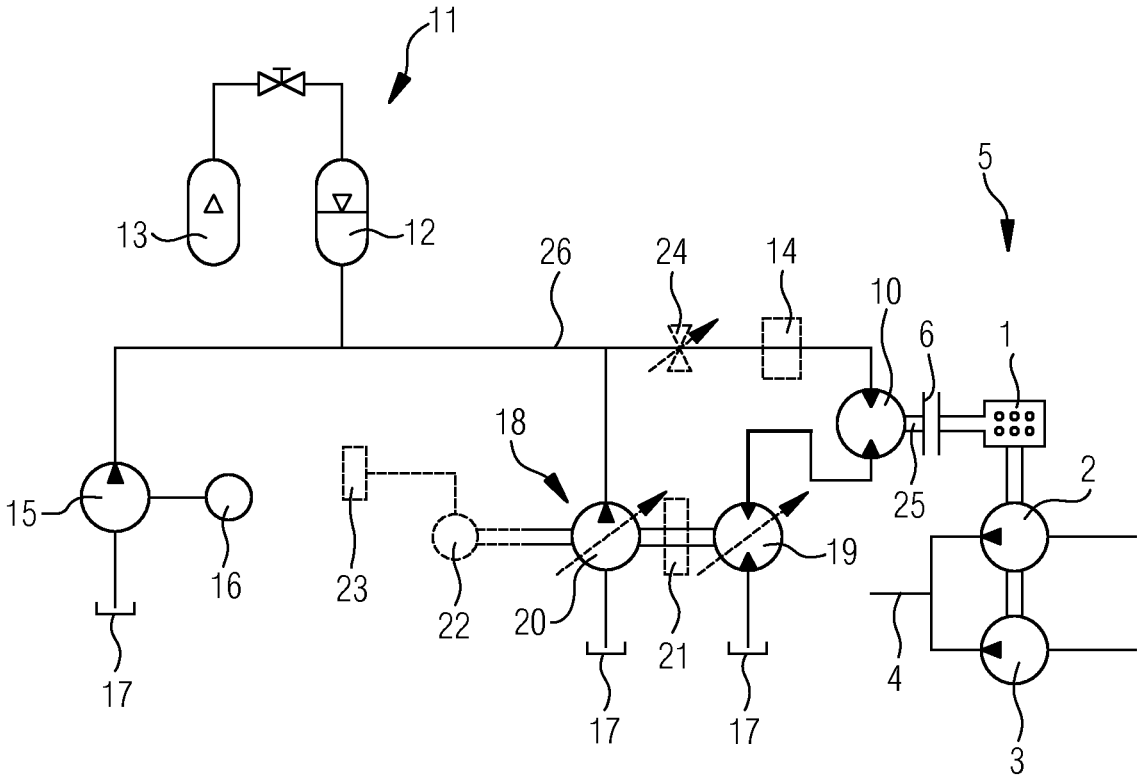
FIG. 1 a first embodiment of the invention with an internal combustion engine that may be propelled by a first hydraulic motor.

FIG. 1 shows a hydrostatic system according to the invention which is used to propel an internal combustion engine, in particular a pumping station for an oil or gas pipeline. However, the invention is not limited to this.

In FIG. 1, the internal combustion engine is numbered as 1, and the feed pumps of the gas pipeline 4, which are shown by way of example, are given numbers 2 and 3. The representation of the pumping station 5 is highly schematic.

The hydrostatic system for starting the internal combustion engine 1 has a hydraulic motor 10, which may be coupled to the internal combustion engine 1 via a clutch 6. In addition or instead of the clutch 6, one or more gear ratios and/or at least one transmission may also be furnished.

The hydraulic motor 10 is supplied from a hydraulic pressure source 11. In the exemplary embodiment shown, the pressure source 11 comprises a pressure accumulator 12, here in the form of an accumulator with a gas tightener. Preferably, an additional gas-filled, and in particular nitrogen-filled, gas accumulator 13 is connected to the pressure accumulator 12, and is connected to the gas side of the pressure accumulator 12 or may be switched into such a flow-conducting connection. Thus, the gas spring of the pressure accumulator may be enlarged and the maximum possible hydraulic medium reservoir in the pressure accumulator 12 increases while the pressure remains constant, in particular at a constant pretension pressure of the gas spring and a constant maximum storage pressure. The gas accumulator 13 has, for example, the same volume as the pressure accumulator 12.

In FIG. 1, it is indicated schematically that in addition to the first hydraulic motor 10, at least one consumer 14 could be furnished in the hydraulic system, which is supplied with hydraulic medium from the pressure source 11. Such a consumer 14 may be, for example, a working cylinder, a hydraulic motor, a pump or the like. The invention is also applicable to a hydrostatic system in which only a corresponding consumer 14 is furnished, and there is no first hydraulic motor 10.

The pressure source 11 may be filled with hydraulic medium by means of a charge pump 15. The charge pump 15 is propelled, for example, by an electric motor 16 and delivers hydraulic medium from the hydraulic reservoir 17.

To control the first hydraulic motor 10, in particular to start the internal combustion engine 1 while minimizing the energy consumed from the hydraulic pressure source 11, a hydraulic motor/pump unit 18 is provided that has an additional hydraulic motor 19 and a hydraulic pump 20, the hydraulic pump 20 being propelled by the additional hydraulic motor 19.

As is indicated schematically, the additional hydraulic motor 19 may be designed as a fixed displacement motor or as a variable displacement motor. Correspondingly, the hydraulic pump 20 may be designed as either a fixed displacement pump or a variable displacement pump. The hydraulic pump 20 may be connected to the additional hydraulic motor 19 in a fixed speed ratio and in particular solely mechanically, so that it rotates in particular at the same rotational speed. Alternatively, a transmission gearing 21 having a variable speed ratio may be provided in the propulsive connection between the additional hydraulic motor 19 and the hydraulic pump 20.

The additional hydraulic motor 19 is connected to the hydraulic pressure source 11, in series with the first hydraulic motor 10 and/or the at least one consumer 14.

By operation of the motor/pump unit 18, the pressure provided by the hydraulic pressure source 11 is reduced, so that the first hydraulic motor 10 provides a correspondingly lower propulsive power at its output shaft 25, which constitutes the power output of the hydrostatic system. At the same time, as a result of propelling the hydraulic pump 20, the volumetric flow through the first hydraulic motor 10 is increased, so that fine-grained control may be achieved, and only the desired small quantity of energy may be drawn off from the hydrostatic system.

As needed, the hydraulic motor/pump unit 18 may include an electric generator or motor-generator 22 to take off additional energy from the hydraulic circuit by charging the electrical accumulator 23. When a motor-generator 22 is provided, this energy may later be fed back into the system by propelling the hydraulic pump 20 and/or the additional hydraulic motor 19.

If the additional hydraulic motor 19 may be operated as a pump that supplies the hydraulic reservoir 17, the differential pressure across the first hydraulic motor 10 or the at least one consumer 14 is increased. In this case, it is also possible that the additional hydraulic motor 19 provides increased pressure for another subsystem or another consumer. In order to thus propel the additional hydraulic motor 19, the motor-generator 22 and/or the hydraulic pump 20 may be used, if the same may be operated by a motor.

If the control capacity of the motor/pump unit 18 is not sufficient to ensure the desired reduction in the propulsive power of the first hydraulic motor 10, and thereby to minimize the consumption of hydraulic medium from the pressure source 11, an adjustable throttle valve 24 may additionally be provided in the pressure line 26 that connects the pressure source 11 to the consumer 14 and/or the first hydraulic motor 10, so as to selectively throttle the hydraulic medium flow from the pressure source 11 to a greater or lesser extent. As a general matter, such a throttle valve 24 could also be provided downstream of the consumer 14 and/or first hydraulic motor 10, in the flow direction of the hydraulic medium, in order to increase the pressure downstream and thereby to reduce the pressure difference across the consumer 14 and/or first hydraulic motor 10.

Figure 2:
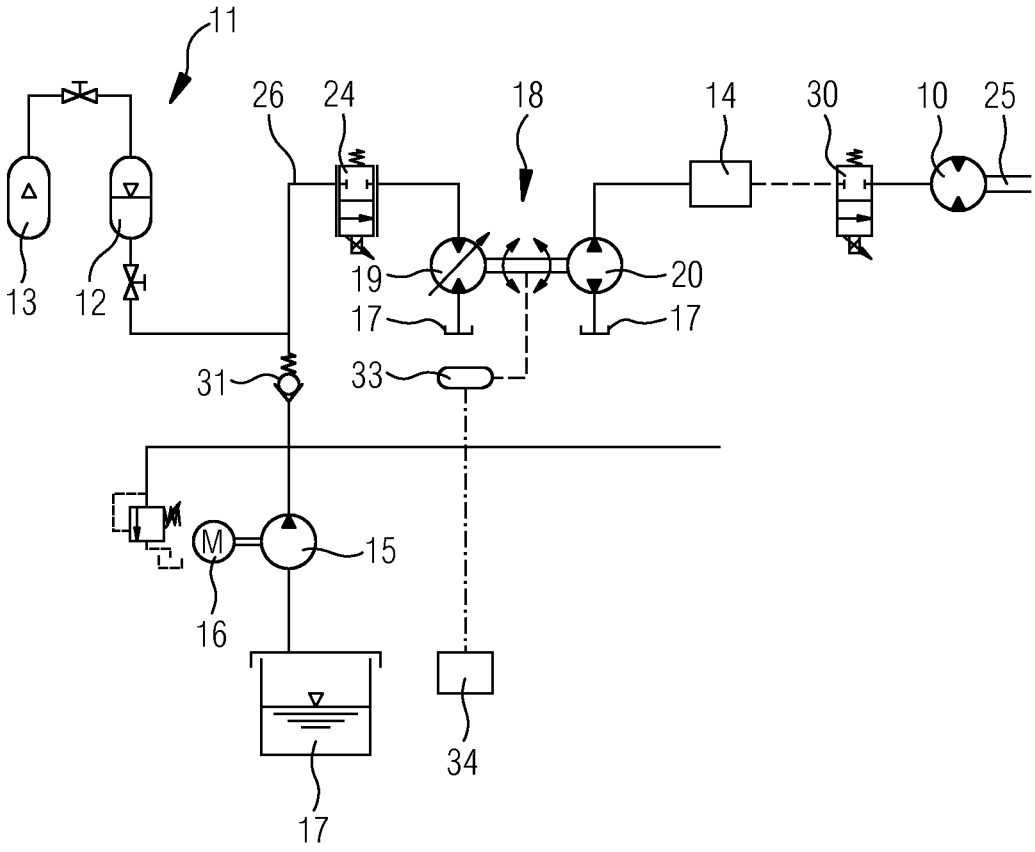
FIG. 2 an alternative configuration of the invention with a consumer that is supplied with pressurized hydraulic medium by means of the hydraulic pump of the motor/pump unit.

In FIG. 2, an alternative configuration of the invention is shown, in which the same reference numerals are used for corresponding parts. In the configuration of FIG. 2, the pressure accumulator 12 is likewise filled by means of the charge pump 15, but in this case this occurs via a check valve 31. This is not mandatory, however.

Also in the configuration of FIG. 2, a hydraulic motor/pump unit 18 is furnished, wherein the additional hydraulic motor 19 is connected to the pressure line 26 and thus connected to the pressure source 11 for its own propulsion. In contrast, for supplying hydraulic medium or pressure to the consumer 14, the hydraulic pump 20 of the hydraulic motor/pump unit 18 is used. Likewise, the hydraulic pump 20 supplies hydraulic medium from the hydraulic medium reservoir 17 to the consumer 14. In this way, the consumer 14 is not connected to the pressure line 26 in series with the additional hydraulic motor 19; instead, the pressure source 11 serves only indirectly to supply pressurized hydraulic medium to the consumer 14. As indicated by the dashed lines in FIG. 2, a first hydraulic motor 10 could be provided in turn, and supplied with hydraulic medium from the hydraulic pump 20, either instead of the consumer 14 or in addition to the consumer 14. The switching on and off of the first hydraulic motor 10 may take place, for example, via a valve 30 shown here in particular, by way of example, as a switching valve or directional control valve.

For example, a sensor 33 is furnished which, together with a control device 34, determines the rotational speed of the hydraulic motor/pump unit 18 and thus indirectly determines the current hydraulic medium consumption of the consumer 14 or the rotational speed of the first hydraulic motor 10 and/or a unit propelled by that motor. A corresponding sensor may of course also be used in the configuration according to FIG. 1.

In the configuration according to FIG. 2, an internal combustion engine, for example a pumping station for an oil or gas pipeline, could also be propelled or accelerated by means of the first hydraulic motor 10, likewise analogously to the embodiment of FIG. 1 or a similar design.

The invention claimed is:

1. A hydrostatic system, comprising:

a hydraulic pressure source;

a first hydraulic motor having an output shaft that forms a mechanical power output of the hydrostatic system, and/or at least one consumer that is provided with pressurized hydraulic medium from said hydraulic pressure source;

a pressure line connecting one or both of said first hydraulic motor, for its own propulsion, or said at least one consumer, for pressurization, to said hydraulic pressure source;

a hydraulic motor/pump unit including an additional hydraulic motor and a hydraulic pump, propulsively connected with each other, to enable said hydraulic pump to be propelled by said additional hydraulic motor;

said additional hydraulic motor being connected to said hydraulic pressure source, for its own propulsion, in series with said first hydraulic motor and/or in series with said at least one consumer; and said hydraulic pump having a pressure side connected to said pressure line.

2. The hydrostatic system according to claim 1, further comprising a hydraulic reservoir, being a hydraulic tank or a hydraulic sump, and at least one charge pump for supplying said hydraulic pressure source from said hydraulic reservoir.

3. The hydrostatic system according to claim 2, wherein said hydraulic pressure source comprises at least one pressure accumulator connected to a charge pump pressure side of said charge pump, for supplying hydraulic medium into said pressure accumulator.

4. The hydrostatic system according to claim 3, wherein said additional hydraulic motor is connected to said hydraulic reservoir for feeding hydraulic medium from said pressure line into the hydraulic reservoir.

5. The hydrostatic system according to claim 2, wherein said hydraulic pressure source comprises at least one pressure accumulator and a gas accumulator connected to said pressure accumulator, which is in a flow-conducting connection with a gas side of the pressure accumulator, or configured to be switched into a flow-conducting connection.

6. The hydrostatic system according to claim 5, wherein said hydraulic pressure source comprises a plurality of pressure accumulators.

7. The hydrostatic system according to claim 2, further comprising a suction line connecting a suction side of said hydraulic pump to said hydraulic reservoir.

8. The hydrostatic system according to claim 1, further comprising a variably adjustable throttle valve for controlling a pressure in the pressure line connected in said pressure line on an input side or output side of said first hydraulic motor, said additional hydraulic motor and/or said at least one consumer.

9. The hydrostatic system according to claim 1, wherein the propulsive connection between said additional hydraulic motor and said hydraulic pump is exclusively a mechanical connection.

10. The hydrostatic system according to claim 1, wherein the propulsive connection between said additional hydraulic motor and said hydraulic pump is a rigid coupling.

11. The hydrostatic system according to claim 10, wherein said rigid coupling is a shaft that carries impellers of said additional hydraulic motor and of said hydraulic pump and/or is torsionally rigidly connected to said impellers.

12. The hydrostatic system according to claim 1, wherein said additional hydraulic motor is a displacement motor and/or said hydraulic pump is a variable displacement pump with a variably adjustable delivery volume per revolution.

13. The hydrostatic system according to claim 1, further comprising a transmission gearing having a variable speed ratio connected in the propulsive connection between said additional hydraulic motor and said hydraulic pump.

14. The hydrostatic system according to claim 1, further comprising an electric generator or electric motor-generator connected to said hydraulic motor/pump unit for energy storage, for reversible energy storage and/or for providing electrical energy.

15. The hydrostatic system according to claim 1, wherein said additional hydraulic motor is configured for operation as a hydraulic pump with or without reversal of a flow direction of the hydraulic medium.

16. The hydrostatic system according to claim 1, wherein said hydraulic pump is driven by a motor.

17. A pumping station for an oil or gas pipeline, the pumping station comprising:

a hydrostatic system according to claim 1;

at least one feed pump for conveying oil or gas through the pipeline;

at least one internal combustion engine connected to said hydrostatic system and configured for driving said at least one feed pump;

wherein said internal combustion engine is in, or configured to be switched into, a propulsive connection with the first hydraulic motor for starting up said internal combustion engine, or said internal combustion engine is a consumer that is provided with pressurized hydraulic medium from the hydraulic pump.

18. A hydrostatic system, comprising:

a hydraulic pressure source;

at least one first hydraulic motor and/or consumer acted upon by pressurized hydraulic medium;

a hydraulic motor/pump unit including an additional hydraulic motor and a hydraulic pump that are in a propulsive connection with each other, enabling said hydraulic pump to be propelled by said additional hydraulic motor;

a pressure line connecting said additional hydraulic motor to said pressure source for its own propulsion; and said first hydraulic motor being connected to a pressure side of said hydraulic pump, for its own propulsion and/or for pressurizing the hydraulic medium for said consumer.

19. The hydrostatic system according to claim 18, further comprising a hydraulic reservoir, being a hydraulic tank or a hydraulic sump, and at least one charge pump for supplying said hydraulic pressure source from said hydraulic reservoir.

20. The hydrostatic system according to claim 19, wherein said hydraulic pressure source comprises at least one pressure accumulator connected to a charge pump pressure side of said charge pump, for supplying hydraulic medium into said pressure accumulator.

21. The hydrostatic system according to claim 20, wherein said hydraulic pressure source comprises a plurality of pressure accumulators.

22. The hydrostatic system according to claim 20, wherein said additional hydraulic motor is connected to said hydraulic reservoir for feeding hydraulic medium from said pressure line into the hydraulic reservoir.

23. The hydrostatic system according to claim 19, wherein said hydraulic pressure source comprises at least one pressure accumulator and a gas accumulator connected to said pressure accumulator, which is in a flow-conducting connection with a gas side of the pressure accumulator, or configured to be switched into a flow-conducting connection.

24. The hydrostatic system according to claim 19, further comprising a suction line connecting a suction side of said hydraulic pump to said hydraulic reservoir.

25. The hydrostatic system according to claim 18, further comprising a variably adjustable throttle valve for controlling a pressure in the pressure line connected in said pressure line on an input side or output side of said first hydraulic motor, said additional hydraulic motor and/or said at least one consumer.

26. The hydrostatic system according to claim 18, wherein the propulsive connection between said additional hydraulic motor and said hydraulic pump is exclusively a mechanical connection.

27. The hydrostatic system according to claim 18, wherein the propulsive connection between said additional hydraulic motor and said hydraulic pump is a rigid coupling.

28. The hydrostatic system according to claim 27, wherein said rigid coupling is a shaft that carries impellers of said additional hydraulic motor and of said hydraulic pump and/or is torsionally rigidly connected to said impellers.

29. The hydrostatic system according to claim 18, wherein said additional hydraulic motor is a displacement motor and/or said hydraulic pump is a variable displacement pump with a variably adjustable delivery volume per revolution.

30. The hydrostatic system according to claim 18, further comprising a transmission gearing having a variable speed ratio connected in the propulsive connection between said additional hydraulic motor and said hydraulic pump.

31. The hydrostatic system according to claim 18, further comprising an electric generator or electric motor-generator connected to said hydraulic motor/pump unit for energy storage, for reversible energy storage and/or for providing electrical energy.

32. The hydrostatic system according to claim 18, wherein said additional hydraulic motor is configured for operation as a hydraulic pump with or without reversal of a flow direction of the hydraulic medium.

33. The hydrostatic system according to claim 18, wherein said hydraulic pump is driven by a motor.

34. A pumping station for an oil or gas pipeline, the pumping station comprising:

a hydrostatic system according to claim 18;

at least one feed pump for conveying oil or gas through the pipeline;

at least one internal combustion engine connected to said hydrostatic system and configured for driving said at least one feed pump;

wherein said internal combustion engine is in, or configured to be switched into, a propulsive connection with the first hydraulic motor for starting up said internal combustion engine, or said internal combustion engine is a consumer that is provided with pressurized hydraulic medium from the hydraulic pump.

* * * * *